US008678093B2

(12) United States Patent
Willoughby

(10) Patent No.: US 8,678,093 B2
(45) Date of Patent: Mar. 25, 2014

(54) INSERTION OF A PACK-OFF INTO A WELLHEAD

(75) Inventor: Daniel A. Willoughby, Uig (GB)

(73) Assignee: Aker Subsea Limited, Berkshire (GB)

( * ) Notice: Subject to any disclaimer, the term of this patent is extended or adjusted under 35 U.S.C. 154(b) by 431 days.

(21) Appl. No.: 13/086,537

(22) Filed: Apr. 14, 2011

(65) Prior Publication Data

US 2011/0253388 A1 Oct. 20, 2011

(30) Foreign Application Priority Data

Apr. 14, 2010 (GB) ..... 1006158.8
Nov. 10, 2010 (GB) ..... 1018985.0

(51) Int. Cl.
*E21B 7/12* (2006.01)
*E21B 33/00* (2006.01)

(52) U.S. Cl.
CPC ..... *E21B 33/00* (2013.01)
USPC ..... 166/338; 166/341; 166/360; 166/368

(58) Field of Classification Search
CPC ..... E21B 7/12
USPC ..... 166/338, 341, 360, 368, 387, 85.3, 179
See application file for complete search history.

(56) References Cited

U.S. PATENT DOCUMENTS 3,344,861 A * 10/1967 Claycomb ..... 166/120
3,410,348 A * 11/1968 Page ..... 166/120
3,468,558 A * 9/1969 Ahlstone ..... 285/18
3,924,678 A * 12/1975 Ahlstone ..... 166/120
3,971,576 A * 7/1976 Herd et al. ..... 285/87
4,262,748 A * 4/1981 Kirkland ..... 166/348
4,289,206 A * 9/1981 Kirkland ..... 166/348
4,390,063 A * 6/1983 Wells, Jr. ..... 166/84.5
4,597,448 A * 7/1986 Baugh ..... 166/348
4,736,799 A 4/1988 Ahlstone
4,819,967 A * 4/1989 Calder et al. ..... 285/18
4,828,037 A * 5/1989 Lindsey et al. ..... 166/382
4,836,579 A * 6/1989 Wester et al. ..... 285/3
4,880,061 A 11/1989 Ahlstone
4,951,988 A * 8/1990 Nobileau ..... 294/86.15
4,969,516 A 11/1990 Henderson et al.
4,969,517 A * 11/1990 Valka et al. ..... 166/208
5,000,266 A * 3/1991 Saunders et al. ..... 166/387
5,013,187 A * 5/1991 MacIntyre et al. ..... 405/169
5,025,864 A * 6/1991 Nobileau ..... 166/348
5,069,288 A * 12/1991 Singeetham ..... 166/348
5,105,888 A 4/1992 Pollock et al.

(Continued)

*Primary Examiner* — Matthew Buck
*Assistant Examiner* — Aaron Lembo
(74) *Attorney, Agent, or Firm* — Nixon & Vanderhye PC

(57) ABSTRACT

Apparatus for the insertion of a pack-off into a recess in a bore of a wellhead body includes an activating sleeve which has a portion disposed for engagement with the pack-off for the movement of the pack-off into the recess and body portions shaped for location on a datum member within the bore. The activating sleeve includes a plurality of apertures circumferentially spaced about the activating sleeve. A running tool which is adapted to move the activating sleeve into engagement with the pack-off carries spring-loaded dogs each disposed in one of the apertures. Each of a plurality of releasing pins is positioned such that it enters a respective one of the apertures when the activating sleeve has caused the pack-off to be located in the recess. The entry of the pins into the apertures causes depression of the dogs out of the apertures and allows the consequent release of the activating sleeve from the running tool.

15 Claims, 3 Drawing Sheets

(56) References Cited

U.S. PATENT DOCUMENTS

| | | | | | |
|---|---|---|---|---|---|
| 5,107,930 | A * | 4/1992 | Hopper | 166/342 |
| 5,163,514 | A * | 11/1992 | Jennings | 166/368 |
| 5,222,555 | A * | 6/1993 | Bridges | 166/208 |
| 5,261,487 | A * | 11/1993 | McLeod et al. | 166/85.3 |
| 5,287,922 | A * | 2/1994 | Bridges | 166/277 |
| 5,421,407 | A * | 6/1995 | Thornburrow | 166/85.3 |
| 6,668,919 | B2 * | 12/2003 | Radi | 166/208 |
| 6,739,398 | B1 | 5/2004 | Yokley et al. | |
| 7,559,366 | B2 * | 7/2009 | Hunter et al. | 166/217 |
| 7,896,081 | B2 * | 3/2011 | Pallini et al. | 166/345 |
| 8,127,853 | B2 * | 3/2012 | Pallini et al. | 166/345 |
| 8,408,309 | B2 * | 4/2013 | Eppinghaus et al. | 166/348 |
| 2003/0121667 | A1 * | 7/2003 | Massie et al. | 166/344 |
| 2012/0097399 | A1 * | 4/2012 | Kobata et al. | 166/348 |

* cited by examiner

INSERTION OF A PACK-OFF INTO A WELLHEAD

This application claims priority from GB patent applications No. 1006158.8 filed Apr. 14, 2010 and No. 1018985.0 filed Nov. 10, 2010, the entire contents of which GB applications are hereby incorporated by reference.

FIELD OF THE INVENTION

This invention relates to wellheads, particularly subsea wellheads and, more particularly, the insertion of a pack-off into a wellhead.

BACKGROUND

Subsea wellheads commonly include hangers for the support of strings of casing which extend down into a well. It is necessary for at least some hangers, particularly a production casing hanger, to be provided with pack-off seals. Such a pack-off is usually inserted in a wellhead by means of a running tool inserted into the wellhead bore. In current practice, the aggregation of tolerances in the complex interface between the tool, a pack-off, a casing hanger and the wellhead is liable to lead to uncertainty of the proper setting of the pack-off.

The present invention accordingly particularly relates to an assembly which provides a simple and reliable interface between a pack-off and a running tool and, more particularly, an interface which ensures the accurate location of the pack-off before it released from the tool. A further aim of the invention is to eliminate the need for a retrieval ring on the running tool for unset pack-offs.

SUMMARY OF THE INVENTION

In one aspect, the invention provides apparatus for the insertion of a pack-off into a recess in a bore of a wellhead body, comprising an activating sleeve which has a portion disposed for engagement with the pack-off for the movement of the pack-off into the recess and has body portions shaped for location on a datum member, the activating sleeve including a plurality of slots circumferentially spaced about the activating sleeve, a running tool which is adapted to move said activating sleeve into engagement with the pack-off and carries a plurality of resiliently loaded dogs each disposed to be located in a respective one of the slots, and release means operative to release the dogs from the slots when the activating sleeve reaches a datum position.

In a particular embodiment of the invention, the said releasing means comprise a plurality of detent pins each positioned adjacent a respective one of said slots and disposed, when the activating sleeve has caused the pack-off to be located in said recess, to engage a respective one of the dogs, whereby the dogs are depressed out of the slots and allow the consequent release of the activating sleeve from the running tool.

The activating sleeve may comprise a slanted upper rim for engagement with the pack-off and for location against the datum member. The activating sleeve may comprise a part for location on a ridge of the datum member.

The apparatus preferably further comprises a resilient collet which fits within the said activating sleeve and urges the activating sleeve into location on the datum member. The collet preferably has slots in register with the slots in the activating sleeve.

The datum member may comprise an outer sleeve which abuts and is located by the bore and a casing hanger. The datum member may have a surface for the guidance of the pack-off into the recess.

The invention also provides a method for the insertion of a pack-off into a recess in a bore of a wellhead body, comprising disposing an activating sleeve for engagement with the pack-off for the movement of the pack-off into the recess, the activating sleeve having body portions shaped for location on a datum member within the bore and including a plurality of slots circumferentially spaced about the activating sleeve, running into the bore a tool which is adapted to move said activating sleeve into engagement with the pack-off and carries a plurality of resiliently loaded dogs each disposed to be located in a respective one of the slots, and releasing the dogs from the slots when the activating sleeve reaches a datum position that requires the correct insertion of the pack-off in the recess.

The invention also provides an assembly for the insertion of a pack-off in a recess in a bore of a wellhead body, comprising an outer sleeve supporting the pack-off, an activating sleeve which has portions for engagement with the pack-off and the outer sleeve, the activating sleeve including a plurality of circumferentially spaced and axially extending slots, and a plurality of detent members located in the outer sleeve and each extending into a respective slot in the activating sleeve.

GENERAL DESCRIPTION

Figure 1:
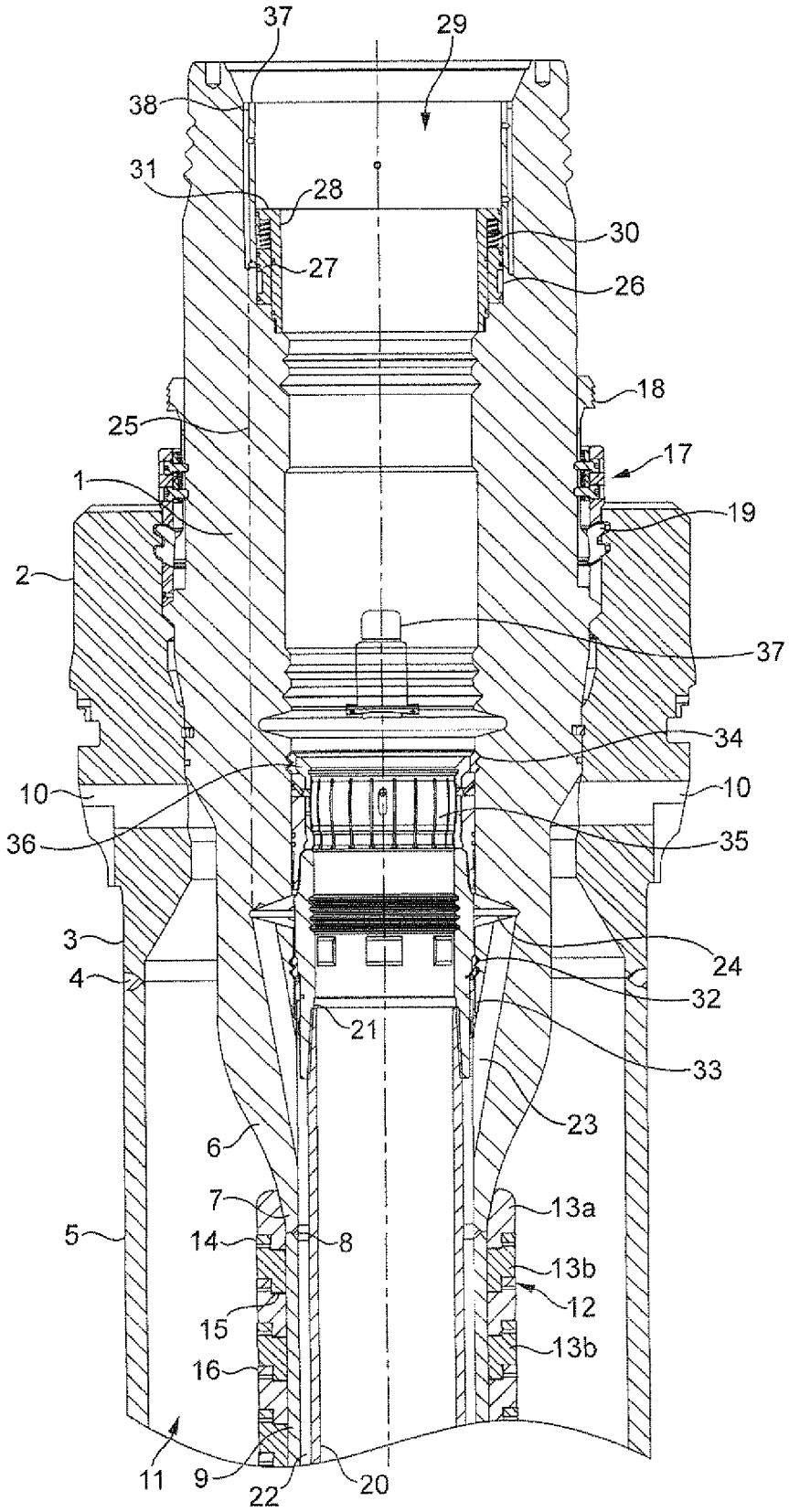
FIG. 1 is a sectional view through a wellhead assembly which includes one embodiment of the invention described by way of example.

FIG. 1 illustrates in section part of a subsea wellhead. The particular wellhead illustrated is designed for use with a riser system of 13⅝" (346 mm) inside diameter within a (standard) 36" (914.4 mm) outside diameter outer conductor. The comparatively slender bore through the wellhead allows a greater thickness for the wellhead than is usual. However, the invention is not necessarily limited to the stated dimensions of the riser system or other components.

The major component of the wellhead is a generally cylindrical wellhead body 1 which is received within a generally cylindrical conductor housing 2. The conductor housing 2 has a lower annular rim 3 which abuts and, by means of a weld 4, supports an outer cylindrical conductor casing 5 that extends downwardly from the conductor housing 2 into a (pre-drilled) hole in the seabed (not shown).

The lower part 6 of the body 1 tapers inwardly to a narrower rim 7 which abuts and, by means of a weld 8, supports a casing extension 9. In this example the casing extension 9 has an outside diameter of 14" (355.6 mm) and an inside diameter of 13⅝" (346 mm).

Typically the casing extension 9 extends down at least as far as the level of the seabed and preferably somewhat further. The conductor casing 2 has lateral vent ports 10 in communication with the annular space 11 between the outer conductor 5 and the casing extension 9.

A column of cement is formed in the space 11 between the outer conductor 5 and the casing extension 9 (and any casing components suspended from it). Cement is pumped down the well and rises up the annular space 11 up to at least the lower part 6 of the body 1.

Wellhead systems are exposed to cyclic forces which will, if great enough, lead to potential fatigue damage and integrity failure of all or part of the wellhead system. Cement on the outside of the wellhead extension will reduce the freedom for the extension to flex to introduce repetitive stresses high enough for potential fatigue failure.

In this example the casing extension 9 is provided with a resilient sleeve 12 made of rubber of other suitable polymeric material. The sleeve preferably extends all the way round the extension and extends from the bottom 6 of the wellhead body 1 for a suitable distance part of, or all, the way down the casing extension 9. The thickness of the sleeve 12 needs to be selected such that it allows some flexure of the casing extension but does not prejudice the structural support that the extension requires. The sleeve 12 is composed of a multiplicity of inter-fitting rings 13*a*, 13*b*. The rings except for the uppermost ring 13*a* each have an upper outer flange 14 and an inner lower flange 15 so that each upper flange 14 fits over a shoulder formed by the lower flange 15 on the adjacent upper ring. The rings thereby fit singly together to form a substantially continuous resilient sleeve on the outside of the casing extension 9. The sleeve 12 may therefore be provided to any desired depth on the casing extension. Each of the upper flanges 14 has a radial through-bore 16 which facilitates the close fitting of the rings 13.

The body 1 and the conductor housing 2 are relatively pre-tensioned by means of a tensioning device 17. This will not be described in detail because it preferably has a construction and manner of operation as described in U.S. Pat. No. 7,025,145 to Emerson, assigned to the assignee of the present application. Very briefly, movement of an operating member 18 causes outward oblique movement of a driving ring 19 and thereby tensioning of the body 1.

Within the casing extension 9 is disposed a production casing 20 extending downwardly from and supported by a production casing hanger 21. Various components associated with this casing hanger 21 are described in detail below. In this example the production casing has a 10.75" (273.05 mm) outside diameter.

The annular space 22 between the production casing and the casing extension 9 is usually called the 'B' annulus. It is desirable to monitor the pressure in the B annulus. Normally the B annulus is sealed by cement at its lower end and sealed by means of a 'pack-off' at the production casing hanger. Monitoring of the pressure within the B annulus enables the detection of, for example, a leak in a casing string. Such a leak is liable to cause collapse or other damage to the production casing.

Extending obliquely upwardly from the inner surface of the lower part 6 of the wellhead body 1 are passageways 23 in communication with an annular gallery 24. Although this gallery opens to the interior of the wellhead bore, it does so between upper and lower pack-offs associated with the casing hanger 21.

Extending upwardly within the body 1 from the gallery 24 is a vertical passageway 25 (mostly shown by a chain line in FIG. 1) which extends to a shoulder 38 at the top of the bore 29, but is blocked at its top. The passageway 25 is in communication with an annular gallery 26 on the outside of a slide valve 27 disposed about a sleeve 28 that fits into the upper part of the bore 29 which extends axially through the wellhead. The valve 27 is biased to a closer (lower) position by means of springs 30 between the top shoulder of the valve and a radial flange 31 of the sleeve 28.

The valve 27 can be moved between its open (upper) position and closed (lower) position by the application of fluid pressure either above or below the valve by way of passageways not shown in FIG. 1. When the valve is in its open position the vertical passageway 25 from the B annulus is in communication by way of the gallery 26 in the valve 27 with an isolation sleeve disposed above the sleeve 28.

The production casing hanger 21 has a lower pack-off 32. Below the lower pack-off 32 is a device 33 (not shown in detail) for the transfer of bearing load from the casing hanger into the wellhead.

Figure 2:
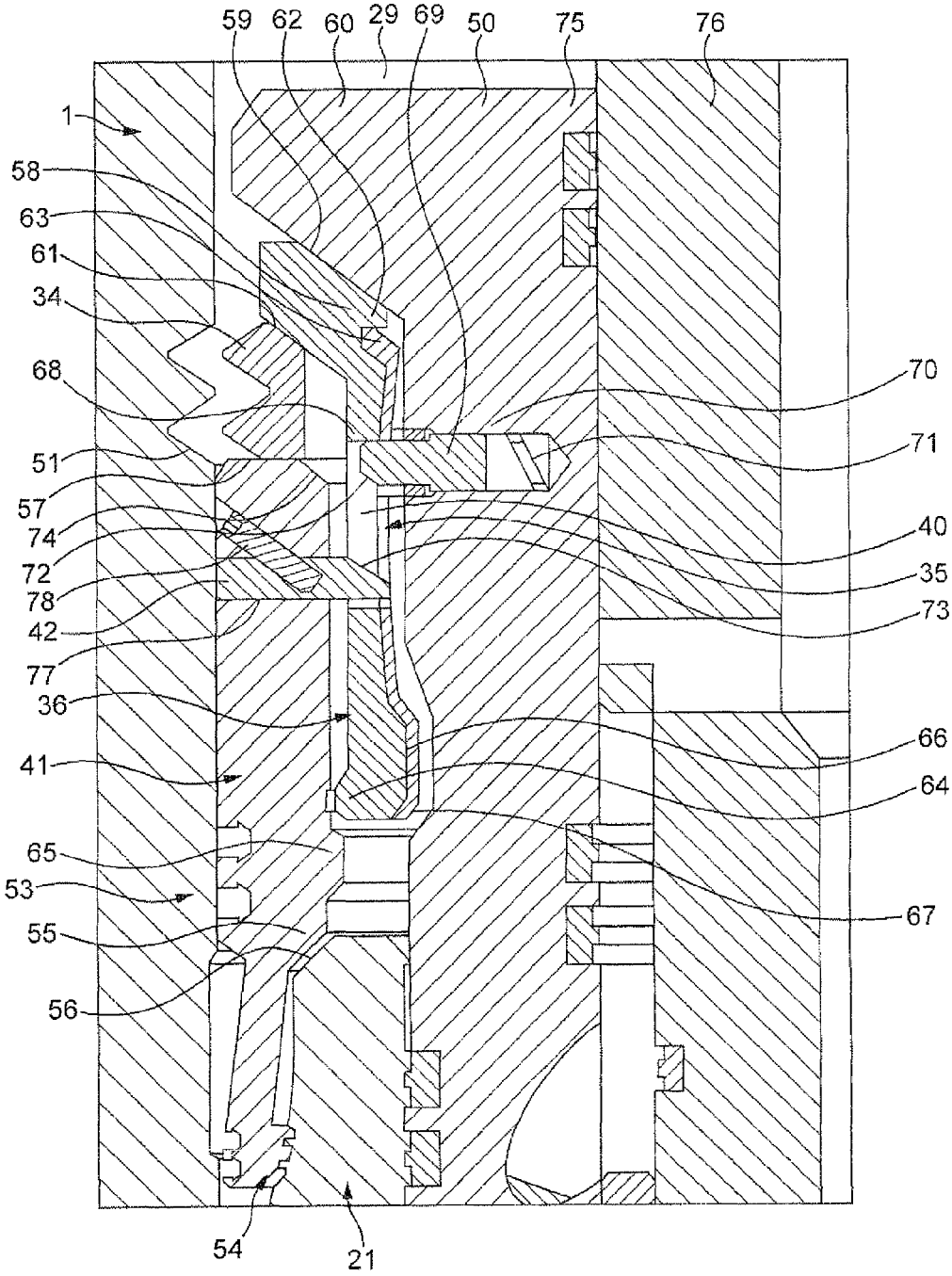
FIGS. 2 and 3 show to a larger scale one exemplary embodiment of the invention in different phases of its operation.
Figure 3:
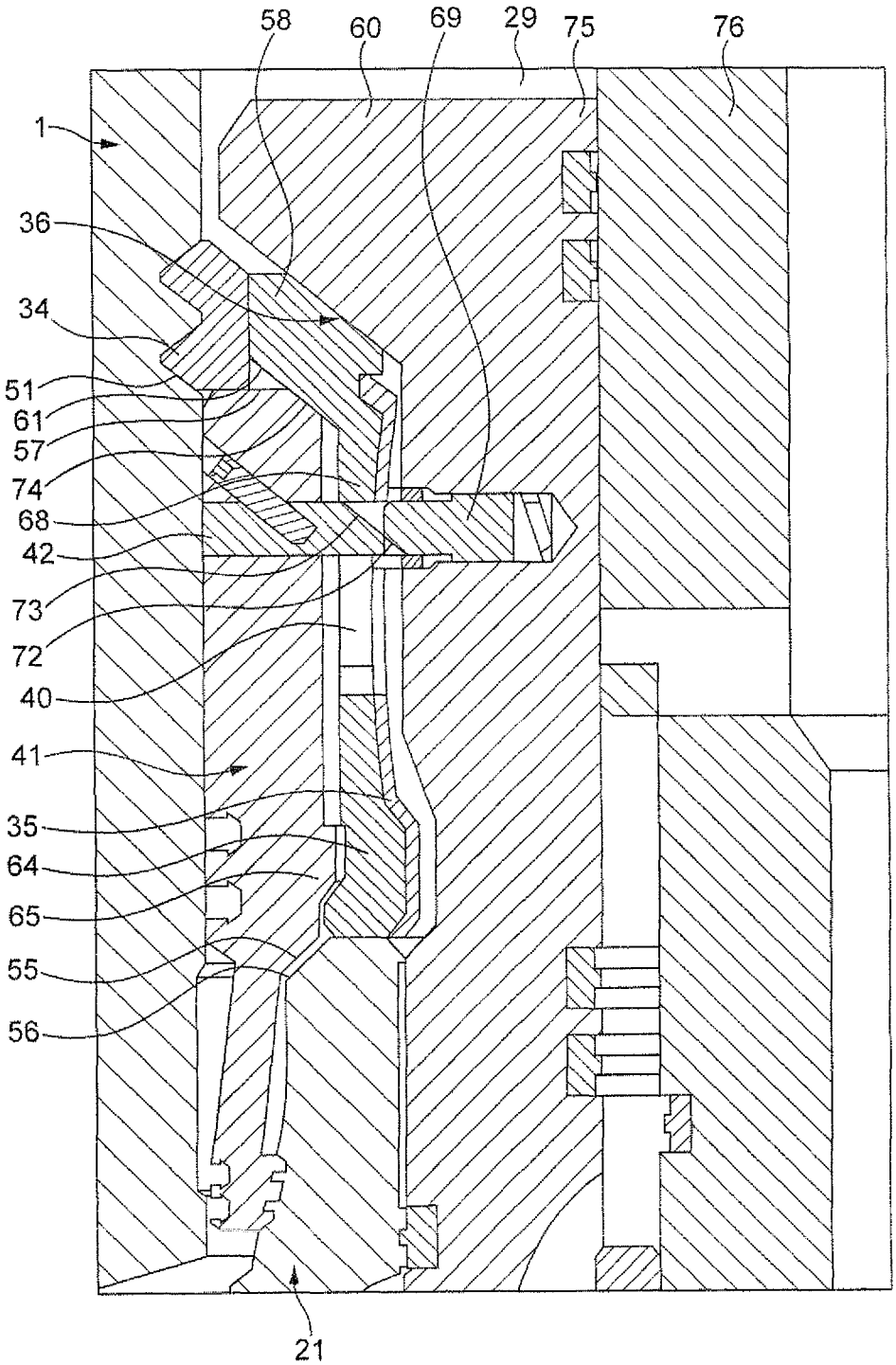

The casing hanger 21 has an upper pack-off 34 which is associated with a resilient annular collet 35 and an activating sleeve 36. The purposes of the activating sleeve 36, which will be described in more detail with reference to FIGS. 2 and 3, are to facilitate the insertion of the pack-off and to ensure that the pack-off is released from a running tool (not shown) only when the pack-off is set in place. The collet 35 is the preferred means for retaining the activating sleeve and is in position when the tool has been withdrawn.

Also shown in FIG. 1 is a slot 37 which allows by-pass of the tubing hanger (not shown) into the body 1 of the wellhead. This feature is not relevant to the claimed invention and will not be described further herein.

PARTICULAR DESCRIPTION OF THE INVENTION

The activating sleeve 36 has a plurality of circumferentially spaced, axially extending slots and the collet 35 has a corresponding plurality of similar slots that are each in register with a respective slot in the activating sleeve 36. Located within an outer sleeve are detent members constituted by pins. Each of these is located in a position adjacent a respective slot in the sleeve 36 and the corresponding slot in the collet 35. The slots and pins are shown to a small scale in FIG. 1 but will be described in detail with reference to the larger scale FIGS. 2 and 3.

The collet 35 has a multiplicity of vertical ribs spaced between each of the slots so that it can urge the sleeve 36 outwardly, whereby to retain the sleeve 36 and thereby the pack-off 34 in their intended final positions.

FIGS. 2 and 3 illustrate the wellhead in the region of the pack-off 34 in greater detail. These figures also illustrate the action of a running tool 50 which is inserted into the bore 29 of the wellhead and initially carries an assembly of the activating sleeve 36, the pack-off 34 and the outer sleeve 41, as well as preferably the collet 35. FIG. 2 illustrates the wellhead and the tool just before the final phase of location of the pack-off 34 and FIG. 3 illustrates the wellhead and the tool at the completion of the final phase of location. FIGS. 2 and 3 are schematic only and represent a vertical half-section through the relevant part of the wellhead and the tool.

The pack-off 34 is to be located in an annular grooved recess 51 in the bore of body 1. The pack-off 34 has an outer periphery which conforms in shape to that of the grooved recess 51.

The outer sleeve 41, which constitutes a reaction or datum member for the location of the pack-off 34, makes sealing engagement with the body 1 and the casing hanger 21 at locations 53 and 54, respectively, and has an inner shoulder 55 which abuts and is located by a top shoulder 56 of the casing hanger 21. The top surface 57 of the outer sleeve 41 is flat, radially directed and aligned with the bottom edge of the recess 51.

The activating sleeve 36 has an outwardly slanted upper rim 58 of which the upper surface 59 is engaged by the head 60 of the tool 50. The lower and outer surface 61 of the rim 58 engages the correspondingly slanted top surface of the pack-off 34. The lower surface of the pack-off 34 abuts the top surface 57 of the outer sleeve 41. Accordingly, downward movement of the activating sleeve 36 under the action of the tool 50 will force the pack-off 34 outwardly into the recess 51.

The top rim 58 of the activating sleeve 36 has on its inner side an annular groove 62 into which an upper rim 63 of the collet 35 fits.

The activating sleeve 36 extends downwardly from the rim 58. Its intermediate, generally cylindrical, part 68 has the axially extending slots 40, of which only one is shown in FIGS. 2 and 3. The slots 40 are spaced circumferentially around the sleeve 36.

The activating sleeve 36 is shaped to locate on the outer sleeve 41. In particular it has at its lower part a foot 64 which, as shown in FIG. 3, eventually locates an annular ridge 65 on the inside of the outer sleeve 41. The lower part of the sleeve 36 has also an inner heel 66 around which the lower margin 67 of the collet 35 fits. The collet 35 has, as previously mentioned, slots each of which corresponds to, and is in radial and axial register with, a respective slot 40 in the activating sleeve 36.

The tool 50 carries a set of circumferentially spaced dogs 69 of which only one is shown in FIGS. 2 and 3. Each dog is mounted in a respective radial bore 70 in the tool and resiliently biased outwards by a respective compression spring 71. Each dog 69 extends through a respective slot in the collet 35 into the respective slot 40 in the activating sleeve.

The assembly of the pack-off and its associated parts is preferably inserted into the wellhead as follows. The outer sleeve 41 is disposed with the pack-off ring 34 above it. The activating sleeve 36 and the collet 35 within it are fitted to, and high on, the outer sleeve 41, the foot 64 being above the ridge 65 on the outer sleeve. The detent pins 42 are inserted through slots 77 in the outer sleeve and are fixed in position in each slot 77 by a respective obliquely disposed screw plug 78.

The assembly of the pack-off 34, the outer sleeve 41, the activating sleeve 35 and preferably the collet 35 is engaged by the running tool 50. This phase is shown in FIG. 2. The dog 69 is at the top of the respective slot 40 whereas the detent pin 42 is spaced from the dog. The dog 69 has a bevelled facet 72 which can be engaged by a bevelled facet 73 of the respective detent pin 42.

Load is applied to the top of the activating sleeve. When the outer sleeve reaches a datum position abutting the hanger 21, it can provide reaction which enables the activating sleeve to push the pack-off ring 34 into the profile 51 in the wellhead bore. The spring parts at the lower end of the activating sleeve 36 snap over the ridge 65. The activating sleeve 36 thereby urges the outer sleeve 41 into sealing engagement (preferably metal-to-metal) with the wellhead bore.

The pack-off is gradually forced outwards into the recess 51 by the rim 58 of the sleeve 36. The rim slides over the top of the pack-off 34 and, when the pack-off 34 is fully in the recess 51, the sleeve 36 can move downwardly to locate against a bevelled shoulder 74 of the outer sleeve 41 as shown in FIG. 3. In this state the foot 64 of the sleeve 36 is located under the ridge 65, so that the activating sleeve 36 is locked in position under the action of the collet 35, which urges the activating sleeve into its location on the outer sleeve 41.

As the rim 58 of the activating sleeve reaches the datum surface 74, the detent pin 42 can abut the spring-loaded dog 69 in the tool 50. The pin 42 can move the dog inwardly against the force of spring 71 to release that dog from the retainer 35 and the sleeve 36. The correct location of the sleeve 36 occurs when the pack-off 34 is fully in the recess 51 and the head 58 of the sleeve 36 contacts the datum surface 74. The position of the detent pin 42 is selected such that if the surface 61 of the head 58 does not reach the surface 74, the dog is not released from the collet 35 and the activating sleeve 36 by the detent pin 42. Thus the pin 42 constitutes a means which is operative to release the dog from the slot 40 only when the sleeve 36 reaches a datum position that requires the correct insertion of the pack-off 34 in the recess 51.

If the pack-off is not correctly set, the dogs 69 will remain in the slots in the activating sleeve 36 and the collet 35; the assembly can therefore be retrieved simply by withdrawal of the tool 50.

The assembly may be retrieved after being set by means of pulling up the activating sleeve 36 by means of the tool 50 or otherwise with sufficient force to move the part 64 of the sleeve 36 upwards over the ridge 65. The activating sleeve 36 will move upwards until the detent pins 42 engage the bottom of the slots 40 in the activating sleeve 36. At this point, the activating sleeve 36 is raised sufficiently, to a position corresponding to that shown in FIG. 2, for the pack-off ring 34 to collapse inwardly and release itself from the profile 51. The pins 42 will now transfer the retrieval force from the activating sleeve 36 to the outer sleeve 41, releasing the seal that the outer sleeve 41 made with the wellhead.

The assembly avoids the use of shearing pins on the tool. It avoids unnecessary debris and is reusable in the event of failure to set the pack-off correctly.

Apart from the dogs such as dog 69 the tool 50 may be of customary design. In practice it may be a multi-purpose tool which comprises concentric inner and outer cylindrical parts 75 and 76. However, the design and purposes of the tool except as are discussed above are not directly relevant to the invention.

The invention claimed is:

1. Apparatus for the insertion of a pack-off into a recess in a bore of a wellhead body, said apparatus comprising:

a datum member located in a bore of a wellhead body and including a portion defining a datum position;

an activating sleeve which has a portion disposed for engagement with the pack-off for the movement of the pack-off into the recess and has body portions shaped for location on said datum member, the activating sleeve including a plurality of slots circumferentially spaced about the activating sleeve;

a running tool which is adapted to move said activating sleeve into engagement with the pack-off and carries a plurality of resiliently loaded dogs each disposed to be located in a respective one of the slots; and release means operative to release the dogs from the slots when the activating sleeve reaches said datum position.

2. The apparatus of claim 1, in which said release means comprises:

a plurality of detent pins each positioned adjacent a respective one of said slots and disposed, when the activating sleeve has caused the pack-off to be located in said recess, to engage a respective one of the dogs, whereby the dogs are depressed out of the slots and allow the consequent release of the activating sleeve from the running tool.

3. The apparatus of claim 2, in which:

the detent pins are located in the datum member.

4. The apparatus of claim 1 in which:

the activating sleeve comprises a slanted upper rim for engagement with the pack-off and for location against the datum member.

5. The apparatus of claim 1 in which:

the activating sleeve comprises a part for location on a ridge of the datum member.

6. The apparatus of claim 1, and further comprising:

an annular resilient collet which fits within the activating sleeve and urges the activating sleeve into location on the datum member.

7. The apparatus of claim 6, in which:

the collet has slots in register with the slots in the activating sleeve.

8. The apparatus of claim 1, in which:

the datum member comprises an outer sleeve which abuts and is located by the bore and a casing hanger.

9. The apparatus of claim 8, in which:

the datum member has a top surface for the guidance of the pack-off into the recess.

10. The apparatus of claim 8, in which:

the outer sleeve makes sealing engagement with the bore.

11. A method for the insertion of a pack-off into a recess in a bore of a wellhead body, comprising the steps of:

(a) disposing an activating sleeve for engagement with the pack-off for the movement of the pack-off into the recess, the activating sleeve having body portions shaped for location on a datum member within the bore and including a plurality of slots circumferentially spaced about the activating sleeve;

(b) running into the bore a tool which is adapted to move said activating sleeve into engagement with the pack-off and carries a plurality of resiliently loaded dogs each disposed to be located in a respective one of the slots; and (c) releasing the dogs from the slots when the activating sleeve reaches a datum position that requires the correct insertion of the pack-off in the recess.

12. An assembly for the insertion of a pack-off in a recess in a bore of a wellhead body, comprising:

an outer sleeve supporting the pack-off;

an activating sleeve which has portions for engagement with the pack-off and the outer sleeve, the activating sleeve including a plurality of circumferentially spaced and axially extending slots; and a plurality of detent members located in the outer sleeve and each extending into a respective slot in the activating sleeve, wherein the outer sleeve is disposed to abut and to be located by the bore and a casing hanger.

13. The assembly of claim 12, in which:

the activating sleeve comprises a slanted upper rim for engagement with the pack-off and for location against the outer sleeve.

14. The assembly of claim 13, in which:

the activating sleeve comprises a lower part for location on a ridge of the outer sleeve.

15. An assembly for the insertion of a pack-off in a recess in a bore of a wellhead body, comprising:

an outer sleeve supporting the pack-off;

an activating sleeve which has portions for engagement with the pack-off and the outer sleeve, the activating sleeve including a plurality of circumferentially spaced and axially extending slots;

a plurality of detent members located in the outer sleeve and each extending into a respective slot in the activating sleeve; and a resilient collet which fits within the activating sleeve.

* * * * *